US007880399B2

(12) United States Patent
Sieβegger

(10) Patent No.: US 7,880,399 B2
(45) Date of Patent: Feb. 1, 2011

(54) BALLAST FOR AT LEAST ONE FLUORESCENT HIGH PRESSURE DISCHARGE LAMP, METHOD FOR OPERATING SAID LAMP AND LIGHTING SYSTEM COMPRISING SAID LAMP

(75) Inventor: Bernhard Sieβegger, München (DE)

(73) Assignee: Osram Gesellschaft mit beschraenkter Haftung, Munich (DE)

( * ) Notice: Subject to any disclaimer, the term of this patent is extended or adjusted under 35 U.S.C. 154(b) by 1133 days.

(21) Appl. No.: 10/565,588

(22) PCT Filed: Jul. 23, 2004

(86) PCT No.: PCT/DE2004/001644

§ 371 (c)(1),
(2), (4) Date: Jun. 20, 2006

(87) PCT Pub. No.: WO2005/011339

PCT Pub. Date: Feb. 3, 2005

(65) Prior Publication Data

US 2007/0138972 A1 Jun. 21, 2007

(30) Foreign Application Priority Data

Jul. 23, 2003 (DE) ..... 103 33 729

(51) Int. Cl.
*H05B 37/00* (2006.01)

(52) U.S. Cl. ..... 315/244; 315/247; 315/209 R; 315/276; 315/290

(58) Field of Classification Search ..... 315/209 R, 315/247, 244, 289–291, 307, 219, 225, 276, 315/278, 246, DIG. 5
See application file for complete search history.

(56) References Cited

U.S. PATENT DOCUMENTS

| | | | | |
|---|---|---|---|---|
| 4,594,531 | A * | 6/1986 | Ganser et al. | 315/307 |
| 5,121,034 | A | 6/1992 | Allen et al. | |
| 5,789,871 | A * | 8/1998 | Shen et al. | 315/291 |
| 5,831,394 | A * | 11/1998 | Huber et al. | 315/224 |
| 5,990,633 | A | 11/1999 | Hirschmann et al. | |
| 6,008,589 | A * | 12/1999 | Deng et al. | 315/209 R |
| 6,194,844 | B1 * | 2/2001 | Rupp et al. | 315/289 |
| 6,323,600 | B1 | 11/2001 | Statnic et al. | |
| 6,914,392 | B2 * | 7/2005 | Hanisch et al. | 315/246 |
| 7,221,103 | B2 * | 5/2007 | Siessegger | 315/274 |

FOREIGN PATENT DOCUMENTS

EP 0 265 237 4/1988

(Continued)

OTHER PUBLICATIONS

Ohsato M H et al: "Characteristics of ballast for HID lamps using single-ended resonant-type MCT inverter" Industry Applications Conference, 1998. Thirty-Third IAS Annual Meeting. The 1998 IEEE St. Louis, MO, USA Oct. 12-15, 1998, New York, NY, USA, IEEE, US, Oct. 12, 1998, pp. 2105-2110, XP010312861 ISBN: 0-7803-4943-1 p. 2105-p. 2109; figures 1-3.

(Continued)

*Primary Examiner*—Haissa Philogene

(57) ABSTRACT

The invention relates to a ballast for a high-pressure discharge lamp, in particular for a motor vehicle headlight lamp or a projection lamp, which ballast is, according to the invention, in the form of a Class E converter.

23 Claims, 11 Drawing Sheets

FOREIGN PATENT DOCUMENTS

| | | |
|---|---|---|
| FR | 2 674 723 | 10/1992 |
| FR | 2 698 515 | 5/1994 |
| WO | 97/43875 A1 | 11/1997 |

OTHER PUBLICATIONS

Ponce M et al; "Electronic ballast for HID lamps with hig frequency square waveform t avoid acoustic resonances" APEC 2001. 16$^{TH}$. Annual IEEE Applied Power Electronics Conference and Exposition. Anaheim, CA, Mar. 4-8, 2001, Annual Applied Power Electronics Conference, New York, NY: IEEE, US, vol. vol. 1 of 2. Conf. 16, Mar. 4, 2001, pp. 658-663, XP010536065 ISBN: 0-7803-6618-2 p. 658-p. 663; figure 3.

Power electronics: converters, applications, and design whose authors are Ned Mohan, Tore M. Undeland and William P. Robbins, second edition 1995, John Wiley & Sons, Inc. pp. 271-273.

* cited by examiner

BALLAST FOR AT LEAST ONE FLUORESCENT HIGH PRESSURE DISCHARGE LAMP, METHOD FOR OPERATING SAID LAMP AND LIGHTING SYSTEM COMPRISING SAID LAMP

The invention relates to a ballast for at least one high-pressure discharge lamp as claimed in the precharacterizing clause of patent claim 1, and to an operating method for at least one high-pressure discharge lamp, as well as to a lighting system.

I. PRIOR ART

A ballast such as this is disclosed, for example, in European Laid-Open Specification EP 0 386 990 A2. This document describes a ballast which allows operation of a metal-halide high-pressure discharge lamp with a frequency-modulated voltage which, inter alia, may also essentially be sinusoidal and whose carrier frequency is in the range from 20 kilohertz to 80 kilohertz. The ballast is in the form of two stages. It essentially comprises a step-up converter with a downstream inverter, which applies an alternating current to the lamp. The starting apparatus essentially comprises a cascade circuit, formed from two or more diodes and capacitors, for voltage multiplication.

II. DESCRIPTION OF THE INVENTION

The object of the invention is to provide a ballast for operation of at least one high-pressure discharge lamp, which ballast has a simpler design. Furthermore, the object of the invention is to specify a simplified operating method for a high-pressure discharge lamp. A further object of the invention is to provide an improved lighting system.

According to the invention, this object is achieved by the features of patent claims 1, 14 and 23, respectively. Particularly advantageous embodiments of the invention are described in the dependent patent claims.

Figure 20:
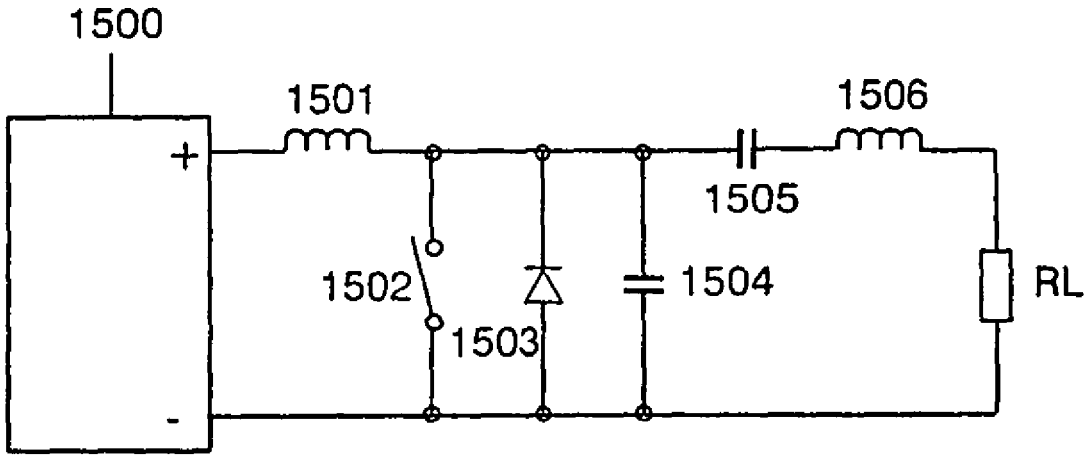

The ballast according to the invention for operation of at least one high-pressure discharge lamp has a voltage converter for production of an essentially sinusoidal alternating current which, according to the invention, is in the form of a Class E converter. In this case, a Class E converter is a converter in accordance with the publication "Class E—A New Class of High-Efficiency Tuned Single-Ended Switching Power Amplifiers" by Nathan O. Sokal and Alan D. Sokal in IEEE Journal of Solid-State Circuits, Vol. SC-10, No. 3, June 1975. The basic design of a Class E converter such as this is shown in FIG. 20. The design and operation of Class E converters, in particular for so-called non-optimum operation, that is to say with a non-optimized load resistance, is described on pages 271 to 273 of the book "Power electronics: converters, applications, and design" whose authors are Ned Mohan, Tore M. Undeland and William P. Robbins, second edition 1995, John Wiley & Sons, Inc.

A Class E converter allows a largely sinusoidal alternating current to be generated in a simple manner for the at least one high-pressure discharge lamp. This means that there is no need for complex bridge circuits with two or more electronic switches and their drive. The operation of the at least one high-pressure discharge lamp with an essentially sinusoidal alternating current has the advantage that it has no harmonic content, or only a very small harmonic content, so that no acoustic resonances are stimulated in the discharge medium in the high-pressure discharge lamp, provided that the frequency of the alternating current is away from the acoustic resonances. Owing to the very low harmonic content of the largely sinusoidal alternating current, the complexity for radio interference suppression of the ballast is likewise low. The sinusoidal lamp current allows stable lamp operation, in particular lamp operation without flickering. The operation of the high-pressure discharge lamp with an alternating current of high frequency, preferably of more than 100 kilohertz, allows the ballast according to the invention to be miniaturized, so that it can be accommodated in the lamp cap. However, there are problems with starting the gas discharge in the high-pressure discharge lamp at very high operating frequencies, since the inductance of the starting transformer is in the same order of magnitude as the lamp impedance, and is no longer negligible. In a situation such as this, it is known for the gas discharge to be started by means of a pulse starting apparatus via an auxiliary electrode in the high-pressure discharge lamp, as is disclosed, for example, in European Laid-Open Specification EP-A 0 868 833. According to one preferred embodiment of the ballast according to the invention, the inductance of the secondary winding of the starting transformer no longer forms a parasitic element, but a functional component of the voltage converter, which is in the form of a Class E converter, to be precise not only during the starting phase of the high-pressure discharge lamp but throughout the entire operation of the lamp. The ballast according to the invention is particularly highly suitable for operation of high-pressure discharge lamps of low power, for example of high-pressure discharge lamps in motor vehicle headlamps or in projection applications, whose electrical power levels are between 25 watts and 35 watts, and in particular of high-pressure discharge lamps with a comparatively low burning voltage of not more than 100 volts, or even not more than 50 volts, such as mercury-free metal-halide high-pressure discharge lamps for motor vehicle headlights. The ballasts for these lamps are operated on the motor vehicle power supply system voltage. The voltage load on the controllable switch in the voltage converter which, according to the invention, is in the form of a Class E converter can be kept correspondingly low during operation of the abovementioned high-pressure discharge lamps with a low burning voltage, even though it reaches approximately 3.6 times the value of the input voltage of the voltage converter when the controllable switch duty ratio is 0.5.

The voltage converter which, according to the invention, is in the form of a Class E converter, for the ballast according to the invention is supplied with a DC voltage and advantageously has the features described in the following text. An inductance and the switching path of a controllable switch are connected between the DC voltage inputs of this voltage converter, as well as between its positive DC voltage input and the ground potential. A diode is arranged back-to-back in parallel with the switching path of this switch. Back-to-back in parallel means that the diode is connected in the reverse-biassed direction for the direct current which is produced by the DC voltage source at the DC voltage input of the Class E converter.

A capacitance is arranged in parallel with the switching path of the switch, and also in parallel with the diode. A circuit in parallel with the capacitance is in the form of a series resonant circuit, to which the load to be operated is coupled. The series resonant circuit in the simplest case comprises a coil and a capacitor. The abovementioned inductance at the DC voltage input of the voltage converter is preferably of such a magnitude that it operates as a constant current source and the current which flows via the switching path of the controllable switch in the closed state and via the capacitance in the open state is composed of a direct current and a sinusoidal alternating current, which is generated by the series resonant circuit. The controllable switch is preferably switched at a clock frequency which is higher than the resonant frequency of the series resonant circuit, in order to ensure that no voltage is applied to the controllable switch during the switching processes, and that the switching losses in the switch are correspondingly low. The diode which is arranged back-to-back in parallel prevents a negative voltage being formed across the switching path of the controllable switch in the Class E converter.

The ballast according to the invention preferably also has a starting apparatus for starting the gas discharge in the high-pressure discharge lamp. This starting apparatus may be arranged in the same housing as all of the other components of the ballast, or else physically separately, for example in the lamp cap of the high-pressure discharge lamp. In order to avoid the starting apparatus and additional components requiring their own voltage source, the starting apparatus is advantageously coupled to an inductance, preferably to the inductance (which operates as a constant current source during lamp operation) of the Class E converter, for its voltage supply. This inductance of the Class E converter is for this purpose advantageously in the form of an autotransformer, particularly when a high supply voltage is required for the starting apparatus.

According to the particularly preferred exemplary embodiments, the starting apparatus is in the form of a pulse starting apparatus, which is often also referred to as a superimposed starting apparatus in the literature. The pulse starting apparatus has a compact design and can thus be integrated in the lamp cap of the high-pressure discharge lamp without any problems. Furthermore, the secondary winding of the starting transformer of the pulse starting apparatus may be in the form of a component of the series resonant circuit of the Class E converter. The inductance of the abovementioned secondary winding is thus also used for the series resonant circuit of the Class E converter. The capacitance of the Class E converter, which is connected in parallel with the switching path of the controllable switch, and the capacitance of the series resonant circuit keep the starting voltage pulses away from the switch in the Class E converter, because this can be regarded approximately as a short circuit for the starting voltage pulses. If the capacitances are very small, a voltage-limiting component can thus additionally be used in parallel with the switch or in parallel with the series circuit comprising the secondary winding of the starting transformer and the lamp. A zener diode, a suppressor diode or a gas-filled surge arrester can be used, for example, as the voltage-limiting component. Alternatively, however, the starting apparatus may also be in the form of a DC voltage starting apparatus, or a resonant starting apparatus. The abovementioned DC voltage starting apparatus can advantageously be used for very high operating frequencies of the Class E converter, and furthermore offers the advantage that it can be coupled to the capacitance of the series resonant circuit of the Class E converter during the starting phase of the high-pressure discharge lamp.

The electrical connections of the at least one high-pressure discharge lamp may be arranged directly in the series resonant circuit of the Class E converter, or else may be inductively coupled to the abovementioned series resonant circuit by means of a transformer. This transformer allows the impedance of the high-pressure discharge lamp to be matched to that of the Class E converter, and also provides DC isolation between the high-pressure discharge lamp and the Class E converter.

Any desired DC voltage source may be used for the DC voltage supply for the voltage converter which, according to the invention, is in the form of a Class E converter, for example even the battery or the generator of a motor vehicle in the case of a motor vehicle headlight high-pressure discharge lamp. However, a step-up converter is preferably connected upstream of the voltage converter, which is in the form of a Class E converter, in order to supply the Class E converter with as stable an input DC voltage as possible, and in order to make it possible to regulate the electrical power consumption of the high-pressure discharge lamp by regulation of the input DC voltage of the Class E converter. If, by way of example, the DC voltage supply for the Class E converter is obtained by rectification from the power supply system AC voltage, a step-down converter may also be used, instead of a step-up converter, for stabilization of the voltage supply for the Class E converter. During the transition from the starting phase to the steady-state operating state of the high-pressure discharge lamp, the power consumption of the high-pressure discharge lamp is advantageously regulated via the magnitude of the supply voltage for the Class E converter, in order to ensure the formation of a stable discharge arc. During the transitional phase, the components of the high-pressure discharge lamp filling, which can be ionized, vaporize. In order to ensure that the transitional phase is as short as possible and that light is emitted as immediately as possible, the high-pressure discharge lamp may be operated at a considerably higher power level during the transitional phase, in this way. Furthermore, the Class E converter can be matched to the impedance of the high-pressure discharge lamp, which changes during the various operation phases, by variation of the supply voltage for the Class E converter and/or of the switching frequency and/or of the duty ratio of the switching means in the Class E converter.

The power of the high-pressure discharge lamp can also be regulated via the switching frequency or the duty ratio of the controllable switch in the Class E converter. The switching frequency and the duty ratio should, however, be chosen (in order to avoid high switching losses) such that there is no voltage across the controllable switch in the Class E converter during the switching processes.

During the starting phase of the high-pressure discharge lamp, the switch in the Class E converter is advantageously switched such that a resonant voltage peak is produced on the inductance which is arranged at the DC voltage input. This resonant voltage peak can advantageously be used to supply the starting apparatus.

The ballast according to the invention allows the production of a largely sinusoidal lamp alternating current using simple means. When the high-pressure discharge lamp is in the steady operating state, the lamp is operated with an essentially sinusoidal alternating current, whose frequency is slightly above the resonant frequency of the series resonant circuit in the Class E converter. The components of the series resonant circuit in the Class E converter are preferably matched to the geometry of the discharge vessel and to the distance between the electrodes in the high-pressure discharge lamp such that the resonant frequency of the series resonant circuit in the Class E converter is in a frequency range which is free of acoustic resonances of the high-pressure discharge lamp. This means that the resonant frequency is in a frequency window which is either above the acoustic resonances or is arranged between two adjacent acoustic resonances. This ensures that no acoustic resonances are stimulated in the high-pressure discharge lamp, because the switching frequency of the Class E converter is slightly above the resonant frequency during steady-state lamp operation. This also means that frequency modulation of the lamp current is not essential. In order to obtain frequency ranges that are free of acoustic resonances and are as wide as possible, the discharge vessel is designed to be cylindrical, at least in the area of the gas discharge. The aspect ratio, that is to say the ratio of the electrode separation and the internal diameter of the cylindrical section of the discharge vessel, is preferably greater than 0.86, and is particularly preferably greater than 2. This results in the longitudinal acoustic resonance being shifted toward low frequencies, and creates sufficiently wide frequency ranges which are free of acoustic resonances.

III. DESCRIPTION OF THE PREFERRED EXEMPLARY EMBODIMENTS

Figure 1:
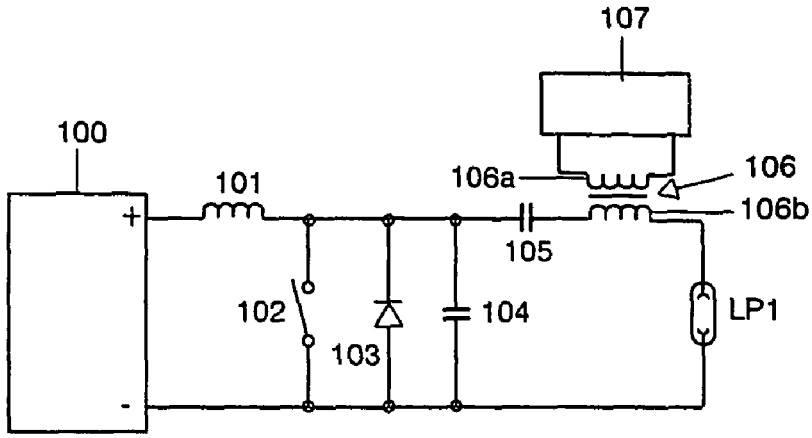
Figure 2:
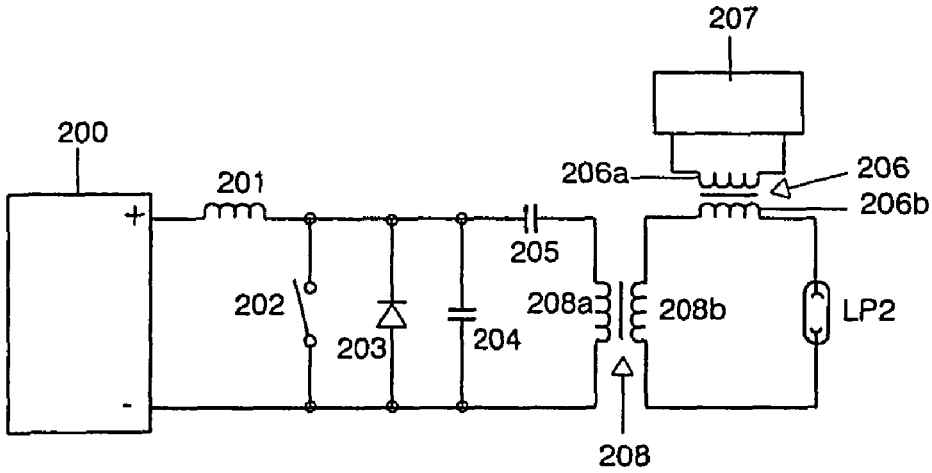
Figure 3:
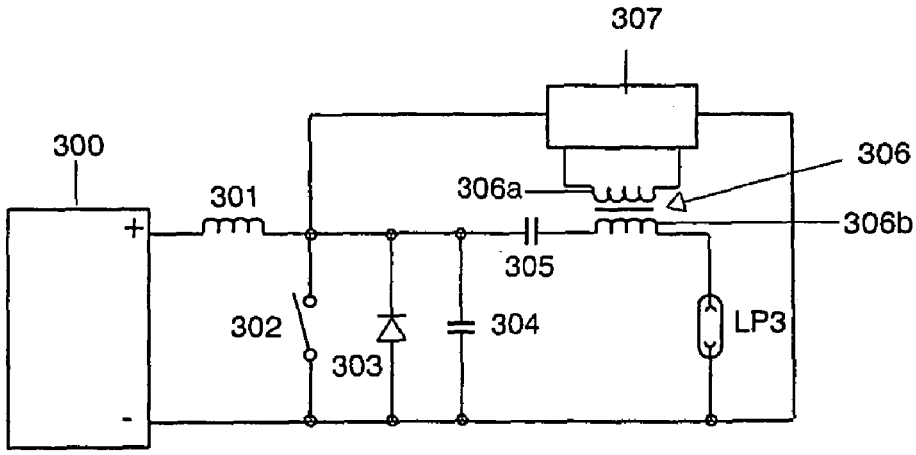
Figure 4:
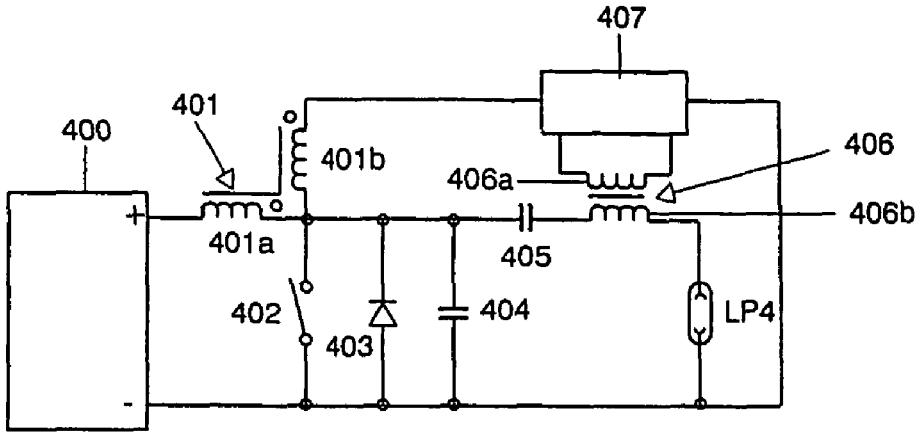
Figure 5:
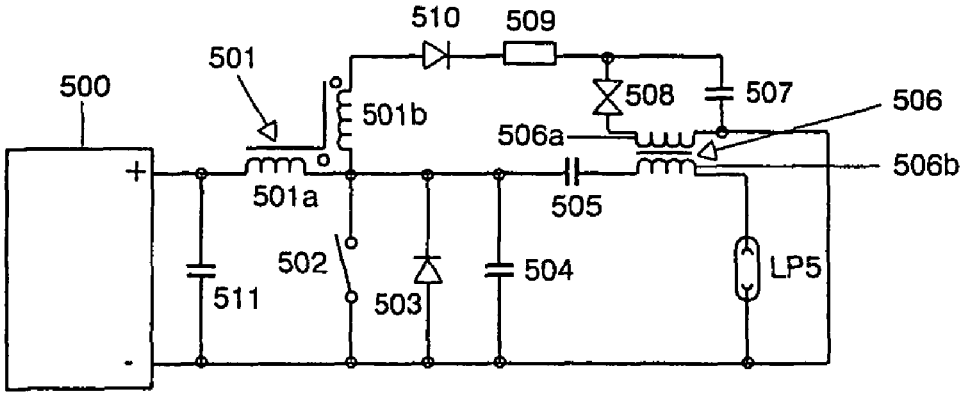
Figure 6:
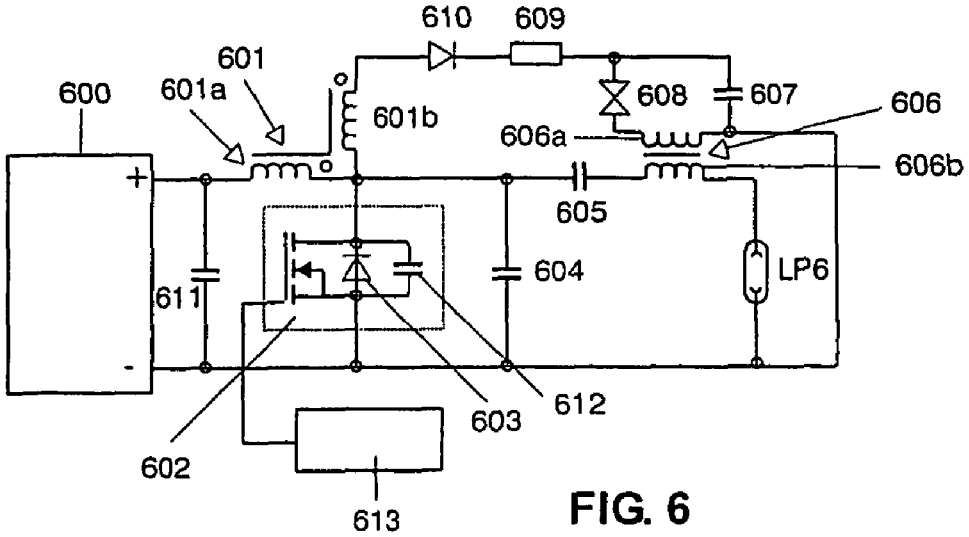
Figure 7:
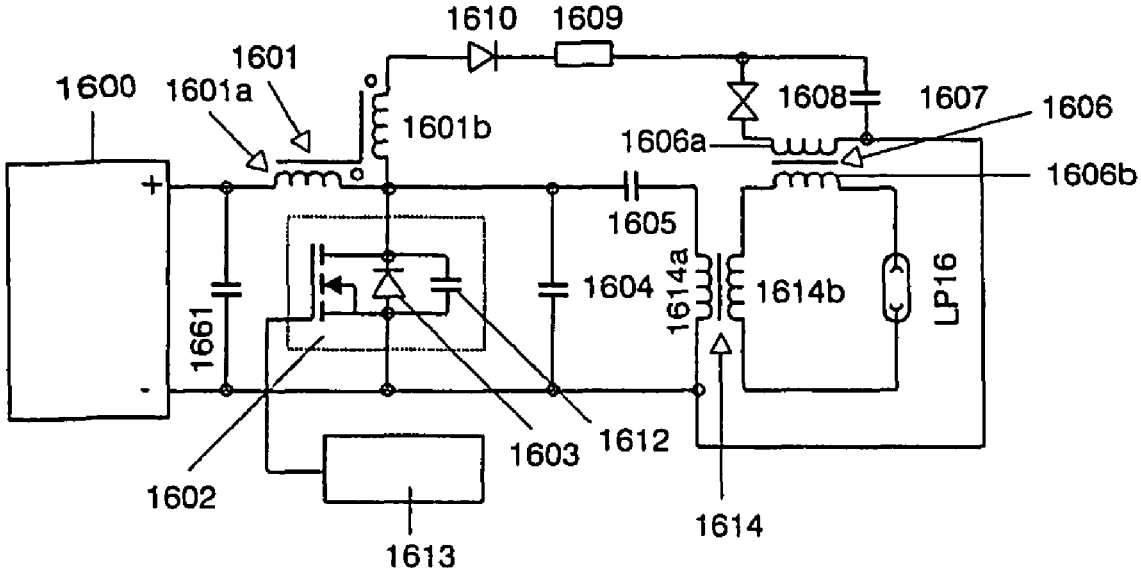
Figure 8:
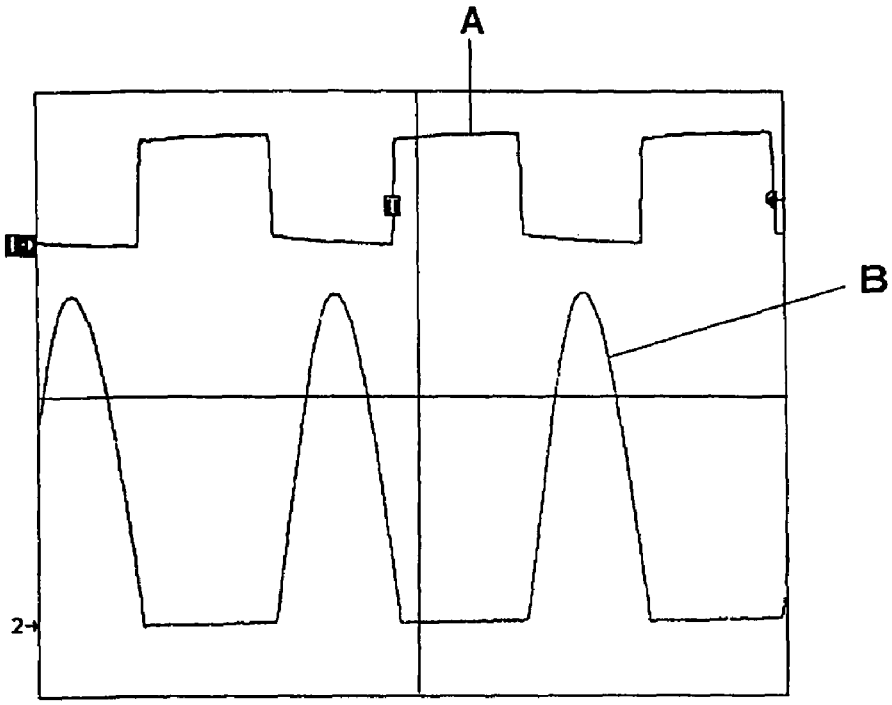
Figure 9:
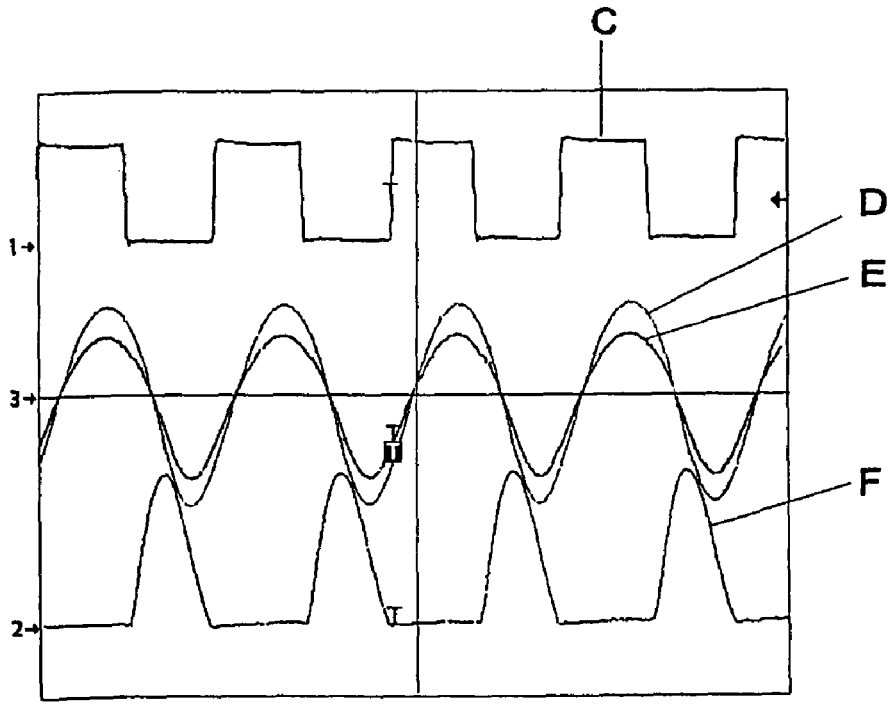
Figure 10:
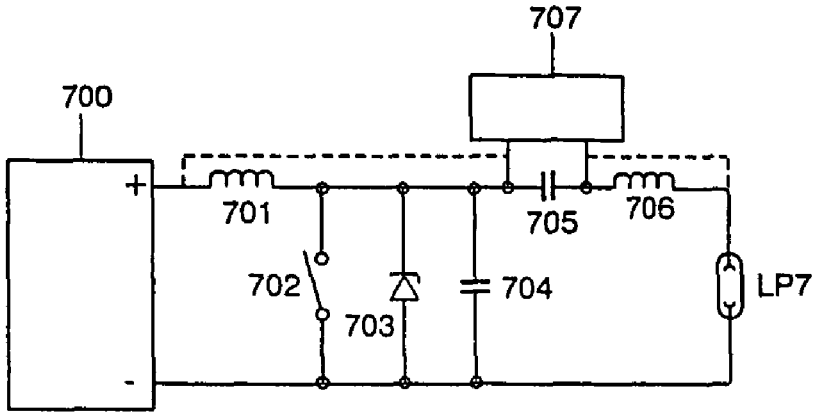
Figure 11:
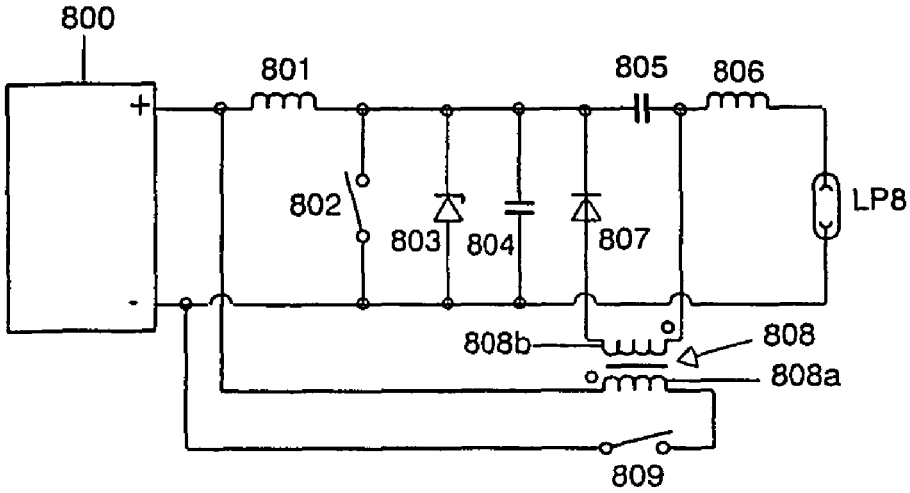
Figure 12:
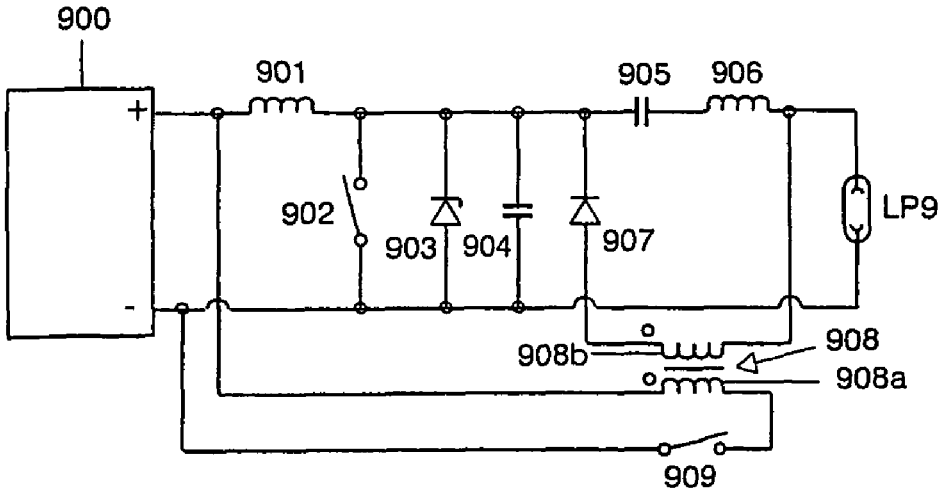
Figure 13:
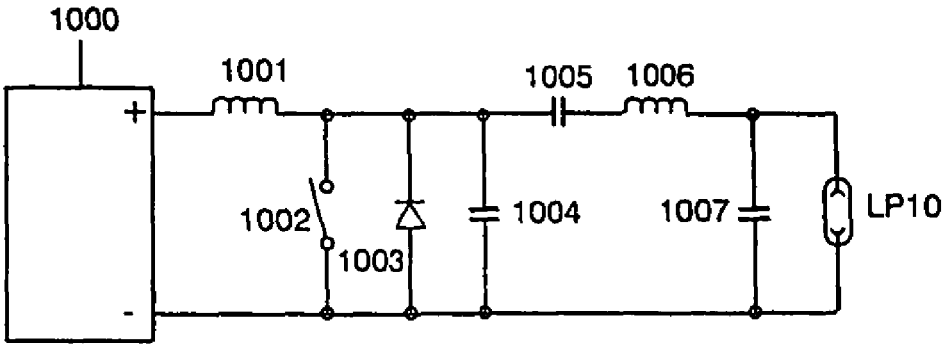
Figure 14:
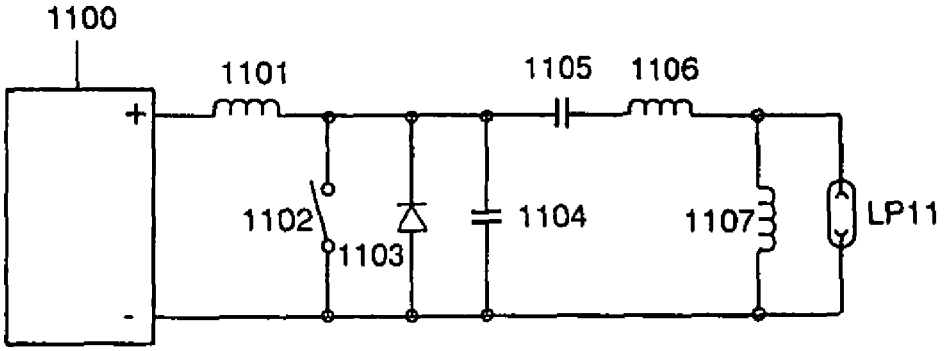
Figure 15:
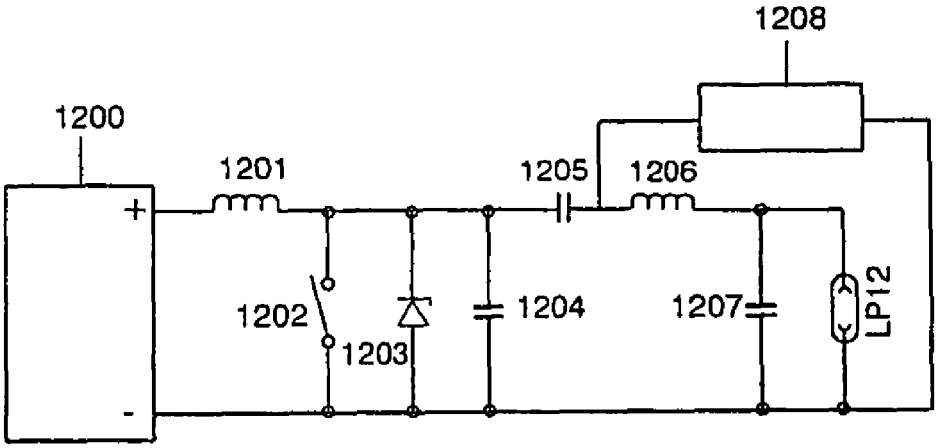
Figure 16:
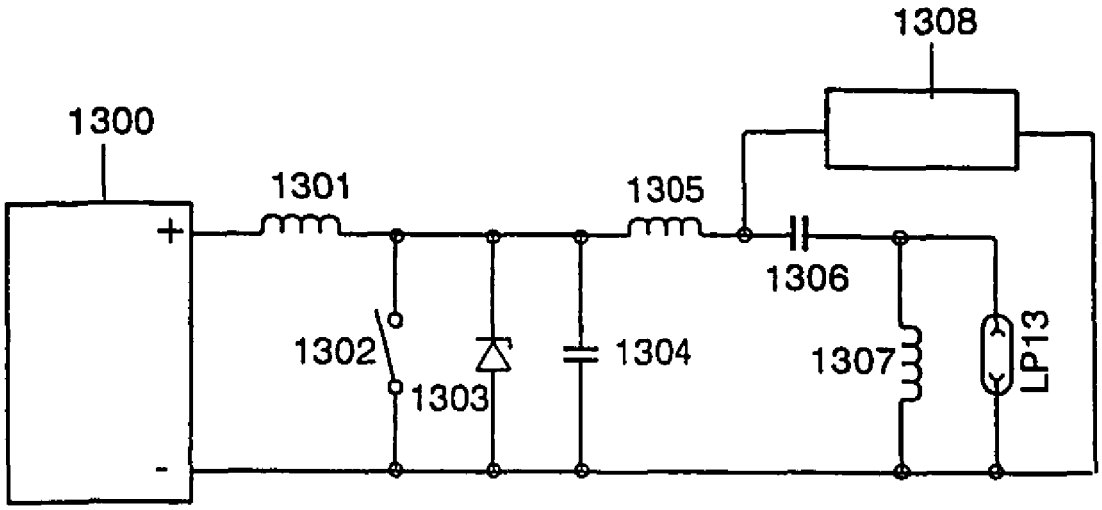
Figure 17:
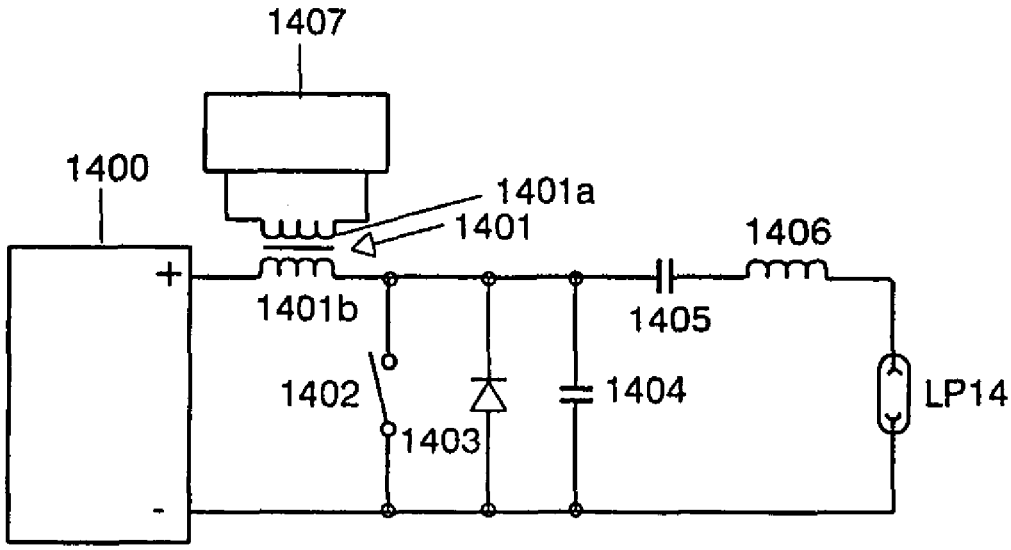
Figure 18:
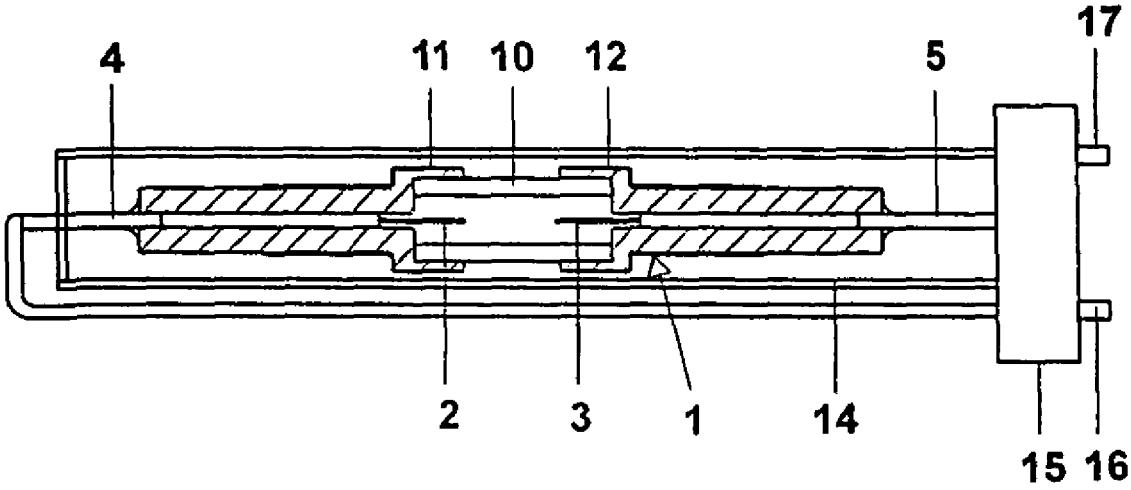
Figure 19:
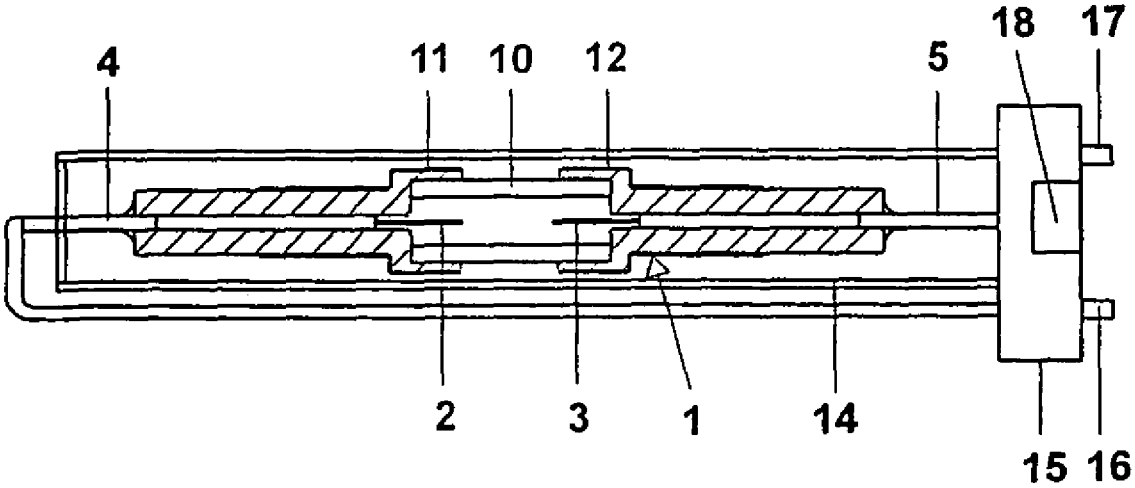
Figure 21:
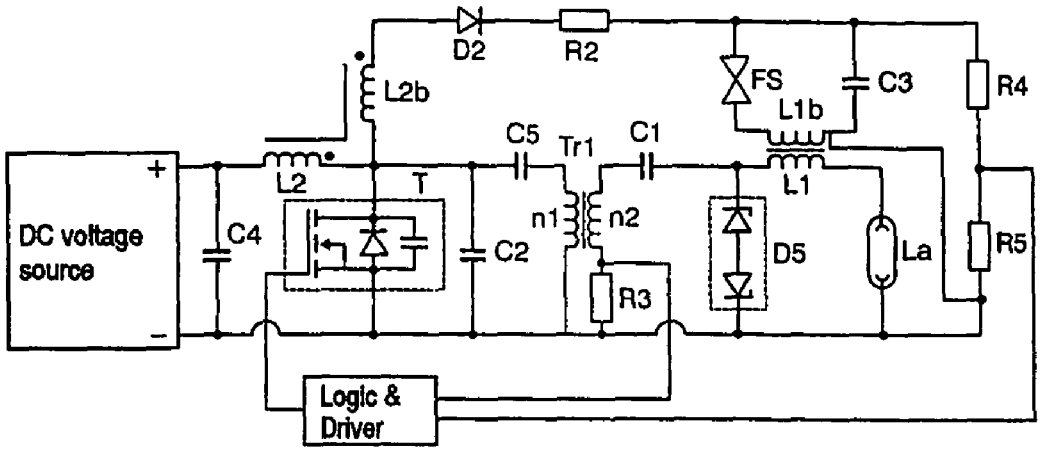
Figure 22:
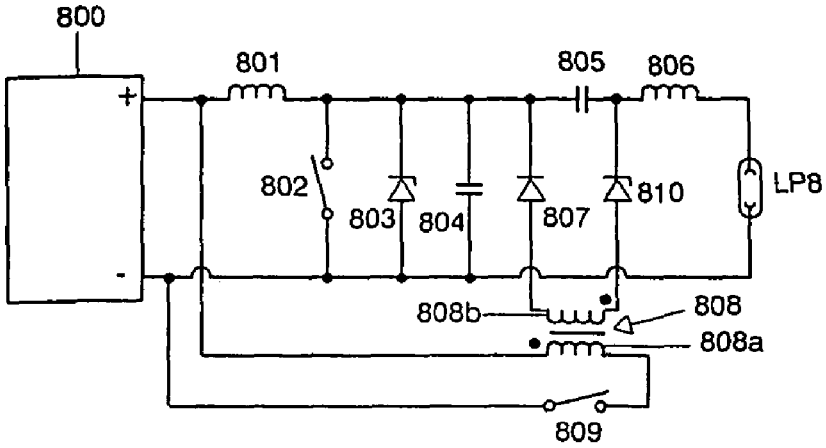
Figure 23:
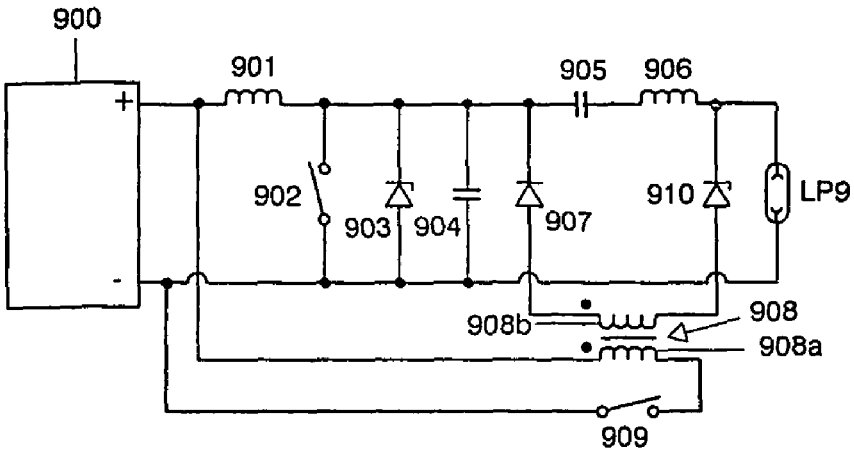

The invention will be explained in more detail in the following text with reference to a preferred exemplary embodiment. In the figures:

FIG. 1 shows an outline sketch of the circuit arrangement of the ballast according to the first exemplary embodiment of the invention, FIG. 2 shows an outline sketch of the circuit arrangement of the ballast according to the second exemplary embodiment of the invention, FIG. 3 shows an outline sketch of the circuit arrangement of the ballast according to the third exemplary embodiment of the invention, FIG. 4 shows an outline sketch of the circuit arrangement of the ballast according to the fourth exemplary embodiment of the invention, FIG. 5 shows an outline sketch of the circuit arrangement of the ballast according to the fifth exemplary embodiment of the invention, FIG. 6 shows an outline sketch of the circuit arrangement of the ballast according to the sixth exemplary embodiment of the invention, FIG. 7 shows an outline sketch of the circuit arrangement of the ballast according to the seventh exemplary embodiment of the invention, FIG. 8 shows the control signal of the MOSFET and the drain/source voltage on the MOSFET during the starting phase of the high-pressure discharge lamp for the exemplary embodiment illustrated in FIG. 7, FIG. 9 shows the control signal for the MOSFET, the drain/source voltage on the MOSFET as well as the lamp alternating current and the voltage drop across the high-pressure discharge lamp during steady-state lamp operation for the exemplary embodiment illustrated in FIG. 7, FIG. 10 shows an outline sketch of the circuit arrangement of the ballast according to the eighth exemplary embodiment of the invention, FIG. 11 shows an outline sketch of the circuit arrangement of the ballast according to the ninth exemplary embodiment of the invention, FIG. 12 shows an outline sketch of the circuit arrangement of the ballast according to the tenth exemplary embodiment of the invention, FIG. 13 shows an outline sketch of the circuit arrangement of the ballast according to the eleventh exemplary embodiment of the invention, FIG. 14 shows an outline sketch of the circuit arrangement of the ballast according to the twelfth exemplary embodiment of the invention, FIG. 15 shows an outline sketch of the circuit arrangement of the ballast according to the thirteenth exemplary embodiment of the invention, FIG. 16 shows an outline sketch of the circuit arrangement of the ballast according to the fourteenth exemplary embodiment of the invention, FIG. 17 shows an outline sketch of the circuit arrangement of the ballast according to the fifteenth exemplary embodiment of the invention, FIG. 18 shows a side view of a high-pressure discharge lamp which is operated using the ballast according to the invention, in the form of a schematic, partially sectioned, illustration, FIG. 19 shows a side view of a high-pressure discharge lamp which is operated using the ballast according to the invention, and which has a starting apparatus integrated in the cap, in a schematic, partially sectioned, illustration, FIG. 20 shows an outline sketch of a Class E converter (prior art), FIG. 21 shows an outline sketch of the circuit arrangement of the ballast according to the sixteenth exemplary embodiment of the invention, FIG. 22 shows an outline sketch of the circuit arrangement of the ballast according to the seventeenth exemplary embodiment of the invention, and FIG. 23 shows an outline sketch of the circuit arrangement of the ballast according to the eighteenth exemplary embodiment of the invention.

Figure 24:
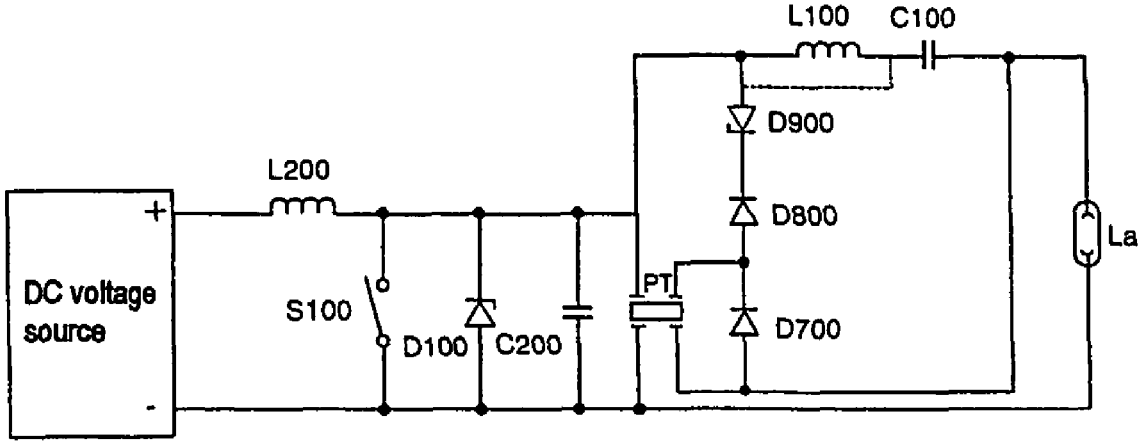

FIG. 24 shows, as an alternative, a starting apparatus with a piezo transformer.

FIG. 1 shows, schematically, the outline sketch of the ballast according to the first exemplary embodiment of the invention. This ballast has a DC voltage input with two DC voltage connections, which are connected to the voltage output of a DC voltage source 100. The positive DC voltage connection is connected via an inductance 101 and the switching path of a controllable switch 102 to the negative DC voltage connection and to the circuit-internal ground potential. A diode 103 is connected back-to-back in parallel with the switching path of the switch 102. A capacitor 104 is connected in parallel with the switching path of the switch 102, as well as in parallel with the diode 103. The capacitor 105 and the secondary winding 106*b* of a transformer 106 are arranged in a circuit in parallel with the capacitor 104. The capacitor 105 and the secondary winding 106*b* form a series resonant circuit. Electrical connections for a high-pressure discharge lamp LP1 are arranged in the series resonant circuit so that, when the lamp LP1 is connected, its discharge path is connected in series with the series resonant circuit. A starting apparatus 107 which has a starting transformer 106 with a primary winding 106*a* and a secondary winding 106*b* is provided in order to start the gas discharge in the high-pressure discharge lamp LP1. During the starting phase of the high-pressure discharge lamp, the required starting voltage is provided at that electrode of the high-pressure discharge lamp which is connected to the secondary winding 106*b*. The starting apparatus 107 may be in the form of a pulse starting apparatus, for example.

The second exemplary embodiment of the ballast according to the invention, which is illustrated in FIG. 2, differs from the first exemplary embodiment in that the high-pressure discharge lamp LP2 is not connected directly to the series resonant circuit of the Class E converter, but is coupled to the abovementioned series resonant circuit via a transformer 208. The transformer 208 has a primary winding 208*a* and a secondary winding 208*b*, and is used for matching the impedance of the lamp LP2 to that of the Class E converter, and for DC isolation of the lamp LP2 from the Class E converter. The impedance matching means that it is also possible to operate high-pressure discharge lamps from the Class E converter which have a burning voltage which differs to a major extent from the supply voltage of the Class E converter. The arrangement and operation of the components 200, 201, 202, 203, 204 and 205 corresponds to the arrangement and operation of the components 100, 101, 102, 103, 104 and 105 in the first exemplary embodiment. The starting apparatus 207 may likewise be in the form of a pulse starting apparatus, and has a starting transformer 206 with a primary winding 206*a* and a secondary winding 206*b*, with the secondary winding 206*b* being connected, together with the high-pressure discharge lamp LP2, in the secondary circuit of the transformer 208. That electrode of the high-pressure discharge lamp LP2 which is connected to the secondary winding 206*b* has high-voltage pulses applied to it during the starting phase. When calculating the resonant frequency of the series resonant circuit of the Class E converter, it is necessary to take account of the transformation ratio of the transformer 208, and the value of the capacitance 205 as well as the inductance of the secondary winding 206*b* of the starting transformer 206.

The transformer 208 can be inserted in the circuit shown in FIG. 1 in various ways for impedance matching, in order to comply with the second exemplary embodiment. By way of example, the primary winding 208*a* of the transformer 208 can be inserted at the node point between the capacitance 105 and the secondary winding 106*b* and at the node point between the capacitance 104 and the high-pressure discharge lamp LP1, as is illustrated in FIG. 2. However, alternatively, the primary winding 208*a* of the transformer 208 can also be inserted at the node point between the secondary winding 106*b* and the high-pressure discharge lamp LP1, and at the node point between the capacitance 104 and the high-pressure discharge lamp LP1 (not illustrated). In the latter case, the transformer 208 can contribute to increasing the starting voltage.

The third exemplary embodiment of the ballast according to the invention, which is illustrated in FIG. 3, is largely identical to the first exemplary embodiment. In particular, the arrangement and the operation of the components 300, 301, 302, 303, 304, 305, 306, 306*a*, 306*b* and LP3 correspond to the arrangement and operation of the corresponding components 100, 101, 102, 103, 104, 105, 106, 106*a*, 106*b* and LP1 in the first exemplary embodiment. The only difference between the two exemplary embodiments is the voltage supply for the starting apparatus 307. The starting apparatus 307 is supplied with voltage from the Class E converter. For this purpose, a voltage input of the starting apparatus 307 is connected to the node point between the inductance 301, the controllable switch 302 and the capacitor 304, and the other voltage input is connected to the ground potential and to the negative DC voltage input of the Class E converter.

The fourth exemplary embodiment of the ballast according to the invention, which is illustrated in FIG. 4, differs from the third exemplary embodiment only by the use of an autotransformer 401 instead of the inductance 301. The autotransformer has only one winding with two winding sections 401*a* and 401*b*. The first winding section 401*a* is connected to the Class E converter and carries out the same function as the inductance 301 in the third exemplary embodiment. The second winding section 401*b* is connected to one voltage input of the starting apparatus 407, and is used for the voltage supply for the starting apparatus 407. The center tap between the two winding sections 401*a*, 401*b* is connected to the node point between the switch 402, the cathode of the diode 403 and the capacitor 404. The other voltage input of the starting apparatus is connected to the earth potential and to the negative DC voltage connection of the DC voltage source 400. The arrangement and the operation of the components 400, 402, 403, 404, 405, 406, 406*a*, 406*b* and LP4 are identical to the arrangement and operation of the corresponding components 300, 302, 303, 304, 305, 306, 306*a*, 306*b* and LP3 in the third exemplary embodiment.

In the exemplary embodiments 3 and 4, a balanced voltage doubler circuit or a cascade circuit can be connected upstream of the starting apparatus for supplying the voltage if the voltage generated by the Class E converter is not sufficient.

The fifth exemplary embodiment of the ballast according to the invention, which is illustrated in FIG. 5, is largely identical to the fourth exemplary embodiment.

In contrast to the fourth exemplary embodiment, this shows details of a pulse starting apparatus and has an additional capacitor 511, which is connected in parallel with the DC voltage input of the Class E converter. The capacitor 511 essentially prevents current being fed back from the autotransformer 501 into the DC voltage source 500. During the starting phase of the high-pressure discharge lamp LP5, the primary winding 501*a* of the autotransformer 501 and the capacitance 504 form a series resonant circuit, since the circuit in parallel with the capacitance 504, comprising the components 505, 506*b* and LP5, is interrupted because the discharge path of the high-pressure discharge lamp LP5 does not conduct. Since the voltage on the capacitance 504 during the starting phase of the high-pressure discharge lamp LP5 in the phase in which the switch 502 is switched off may be greater than the supply voltage, this may result in the current flow in the inductance 501*a* being reversed at times. The pulse starting apparatus comprises the starting transformer 506, the starting capacitor 507, the spark gap 508, the resistor 509 and the rectifier diode 510. The voltage input of the pulse starting apparatus is connected via the winding 501*b* of the autotransformer to the node point between the switch 502, the diode 503 and the capacitor 504. The other voltage input, that is to say the node point between the starting capacitor and the primary winding 506*a* of the starting transformer 506 is connected to ground potential and to the negative DC voltage connection of the DC voltage source 500. The arrangement and operation of the components 500, 501, 501*a*, 501*b*, 502, 503, 504, 505, 506, 506*a*, 506*b* and LP5 corresponds to the arrangement and operation of the corresponding components 400, 401, 401*a*, 401*b*, 402, 403, 404, 405, 406, 406*a*, 406*b* and LP4 in the fourth exemplary embodiment. During the starting phase of the high-pressure discharge lamp LP5, the starting capacitor 507 is charged by means of the DC voltage source and the autotransformer 501, via the diode 510 and the resistor 509, to the breakdown voltage of the spark gap 508. On reaching the breakdown voltage, the capacitor 507 is suddenly discharged via the spark gap 508, with the discharge current flowing through the primary winding 506*a* of the starting transformer 506. Owing to the high transformation ratio, high-voltage pulses for that electrode of the high-pressure discharge lamp LP5 which is connected to the secondary winding 506*b* are induced in the secondary winding 506*b*, and lead to ignition of the gas discharge in the lamp LP5. During steady-state lamp operation, the starting capacitor 507 is not sufficiently charged to trigger breakdown of the spark gap 508.

The sixth exemplary embodiment of the ballast according to the invention, which is illustrated in FIG. 6, is identical to the fifth exemplary embodiment. In particular, the arrangement and operation of the components 600, 601, 601*a*, 601*b*, 602, 603, 604, 605, 606, 606*a*, 606*b*, 607, 608, 609, 610, 611 and LP6 are identical to those of the corresponding components 500, 501, 501*a*, 501*b*, 502, 503, 504, 505, 506, 506*a*, 506*b*, 507, 508, 509, 510, 511 and LP5 in the fifth exemplary embodiment. In contrast to the fifth exemplary embodiment, the sixth exemplary embodiment illustrates details of the controllable switch 602. In this case, the controllable switch 602 is a field-effect transistor, in particular a MOSFET. The diode 603, which is connected back-to-back in parallel with its switching path, is in this case already integrated in the MOSFET 602, in the form of a body diode. The MOSFET 602 has a parasitic capacitance 612 which is created in parallel with the drain/source path by virtue of the internal design of the MOSFET and which (if the switching frequencies of the field-effect transistor 602 are sufficiently high, that is to say during operation of the high-pressure discharge lamp LP6 with an alternating current at a sufficiently high frequency) can be used instead of the capacitor 604, and must be taken into account in the selection of the capacitor 604. The gate connection of the field-effect transistor 602 is connected to a control circuit 613, which is used to control the switching processes of the transistor 602. Table 1 shows the individual components chosen for the circuit arrangement based on the sixth exemplary embodiment of the invention.

During the starting phase of the high-pressure discharge lamp LP6, the DC voltage source 600 produces a DC voltage of 120 volts at the voltage input of the Class E converter. The field-effect transistor 602 is switched by the control circuit 613 at a switching frequency of about 87 kilohertz, and at a duty ratio of 0.5. The starting capacitor 607 is charged to the breakdown voltage of the spark gap 608 by means of the DC voltage source 600 and the autotransformer 601, via the diode 610 and the resistor 609. On reaching the breakdown voltage of the spark gap 608, the starting capacitor 607 is discharged suddenly via the primary winding 606*a* of the starting transformer 606, in whose secondary winding 606*b* high-voltage pulses of up to 40 000 volts are induced, in order to ignite the gas discharge in the high-pressure discharge lamp. Immediately after ignition of the gas discharge in the high-pressure discharge lamp, the gas discharge is borne mainly by the xenon in the ionizable filling. During the transition from the starting phase to steady-state lamp operation, the other filling components, the metal halides, vaporize and contribute to the discharge and to the light emission. During this period, the supply voltage of 120 volts produced by the DC voltage source 600 is continuously reduced to a value of 70 volts, in order in this way to produce the desired lamp power. The electrical characteristics, in particular the impedance of the high-pressure discharge lamp LP6 change considerably during the transition from the starting phase to steady-state operation. During the transition phase, the lamp LP6 is operated at increased power in order to ensure that the transition to steady-state lamp operation takes place as quickly as possible. Once the lamp current has started, the switching frequency of the field-effect transistor 602 is increased from about 87 kilohertz to about 360 kilohertz. Once the gas discharge in the high-pressure discharge lamp LP6 has ignited, the voltage drop across the starting capacitor 607 no longer reaches the breakdown voltage of the spark gap 608. The secondary winding 606 of the starting transformer 606*b* is used, after the end of the starting phase, as a resonant inductance 606*b* in the series resonant circuit of the Class E converter. The high-pressure discharge lamp LP6 is a mercury-free metal-halide high-pressure discharge lamp with an electrical power consumption of 30 watts and a burning voltage of about 30 volts. It is used as a motor vehicle headlight lamp. The DC voltage source 600 includes a step-up converter, whose voltage output forms the DC voltage output of the DC voltage source 600, and which generates the supply voltage for the Class E converter from the motor vehicle power supply system voltage.

The seventh exemplary embodiment, which is illustrated in FIG. 7, is largely identical to the second exemplary embodiment of the ballast according to the invention, which is illustrated in FIG. 2. In contrast to the second exemplary embodiment, the seventh exemplary embodiment also illustrates details of the pulse starting apparatus and of the controllable switch. The controllable switch is in this case a field-effect transistor, in particular a MOSFET 1602, and is controlled by the control circuit 1613. Furthermore, the inductance at the positive DC voltage connection of the DC voltage source 1600 is in the form of an autotransformer 1601, and a capacitor 1661, preferably with a high capacitance, is connected in parallel with the DC voltage output of the DC voltage source 1600, in order to prevent any reactions from the autotransformer 1601 on the DC voltage source 1600, as has already been explained with reference to the fifth exemplary embodiment on the basis of the corresponding component 511 and FIG. 5. The first winding section 1601*a* of the autotransformer 1601 is connected to the Class E converter, so that the positive DC voltage connection of the DC voltage source 1600 is connected via the first winding section 1601*a* and the drain/source path through the field-effect transistor 1602 to the negative DC voltage connection of the DC voltage source 1600 and to the ground potential. The second winding section 1602*b* of the autotransformer 1602 is used for the voltage supply for the pulse starting apparatus. A diode 1603 is connected back-to-back in parallel with the switching path, that is to say the drain/source path, through the transistor 1602, and in this case integrated in the transistor 1602 as a so-called body diode in the transistor 1602. A capacitor 1604 is connected in parallel with the diode 1603 and in parallel with the drain/source path through the transistor 1602, whose capacitance must take account of the parasitic capacitance 1612 of the transistor 1602, as has already been explained with reference to the sixth exemplary embodiment, on the basis of the transistor 602 and FIG. 6. The circuit in parallel with the capacitor 1604, which comprises the capacitance 1605 and the primary winding 1614*a* of the transformer 1614, is in the form of a series resonant circuit. The secondary winding 1614*b* of the transformer 1614 supplies energy to the circuit which is connected to it and comprises the secondary winding 1606*b* of the starting transformer 1606 and the high-pressure discharge lamp LP16, or the electrical connections of the high-pressure discharge lamp. In order to supply voltage to the pulse starting apparatus, the second winding section 1601*b* of the autotransformer 1601 is connected to the node point between the source connection of the transistor 1602, the cathode of the diode 1603 and the capacitor 1604 as well as the capacitance 1605. The starting capacitor 1607 is charged by means of the winding section 1601*b* via the diode 1610 and the resistor 1609 to the breakdown voltage of the spark gap 1608, which is connected in parallel with the starting capacitor 1607. On reaching the breakdown voltage of the spark gap 1608, the starting capacitor 1607 is discharged suddenly via the primary winding 1606*a* of the starting transformer 1606. In consequence, high-voltage pulses are induced in the secondary winding 1606*b* of the starting transformer 1606 in order to ignite the gas discharge in the high-pressure discharge lamp. The node point between the starting capacitor 1607 and the primary winding 1606*a* of the starting transformer 1606 is connected to the ground potential and to the negative connection of the DC voltage source 1600. The transformer 1614 is used to match the impedance of the high-pressure discharge lamp LP16 to that of the Class E converter, and for DC isolation of the Class E converter. The transformer 1614 may also be in the form of an autotransformer, if there is no requirement for DC isolation. Table 2 shows the details of the components that are used.

During the starting phase of the high-pressure discharge lamp LP16, the DC voltage source 1600 produces a DC voltage of 80 volts at the voltage input of the Class E converter. The field-effect transistor 1602 is switched by the control circuit 1613 at a switching frequency of about 59 kilohertz and at a duty ratio of 0.5. The starting capacitor 1607 is charged by means of the DC voltage source 1600 and the autotransformer 1601 via the diode 1610 and the resistor 1609, to the breakdown voltage of the spark gap 1608. On reaching the breakdown voltage of the spark gap 1608, the starting capacitor 1607 is discharged suddenly via the primary winding 1606*a* of the starting transformer 1606, in whose secondary winding 1606*b* high-voltage pulses of up to 40 000 volts are induced in order to ignite the gas discharge in the high-pressure discharge lamp. Immediately after the ignition of the gas discharge in the high-pressure discharge lamp LP16, the gas discharge is borne mainly by the xenon in the ionizable filling. During the transition from the starting phase to steady-state lamp operation, the further filling components, the metal halides, vaporize and contribute to the discharge and to the light emission. During this time, the supply voltage of 80 volts which is produced by the DC voltage source 1600 is reduced continuously to a value of 40 volts, in order thus to produce the desired lamp power. The electrical characteristics, in particular the impedance of the high-pressure discharge lamp LP16, change considerably during the transition from the starting phase to steady-state operation. During the transitional phase, the lamp LP16 is operated at higher power in order to ensure that the transition to steady-state lamp operation takes place as quickly as possible. Once the lamp current has started, the switching frequency of the field-effect transistor 1602 is increased from about 59 kilohertz to about 215 kilohertz. Once the gas discharge in the high-pressure discharge lamp LP16 has been ignited, the voltage drop across the starting capacitor 1607 no longer reaches the breakdown voltage of the spark gap 1608.

The high-pressure discharge lamp LP16 is a mercury-free metal-halide high-pressure discharge lamp with an electrical power consumption of 30 watts and a burning voltage of about 30 volts, as has already been described for the sixth exemplary embodiment. It is used as a motor vehicle headlight lamp. The DC voltage source 1600 contains a step-up converter, whose voltage output forms the DC voltage output of the DC voltage source 1600, and which generates the supply voltage of the Class E converter from the motor vehicle power supply system voltage. However, there is no need for the step-up converter if the power supply system voltage is sufficiently high or if the transformer 1614 is suitably designed.

The curve A in FIG. 8 shows the time profile of the essentially square-wave control voltage which is supplied from the control circuit 1613 to the gate of the transistor 1602 during the starting phase of the high-pressure discharge lamp LP6, and the curve B shows the time profile of the voltage drop across the switching path, that is to say the drain/source path through the transistor 1602. The zero level on the two voltage profiles is in each case indicated by the number 1 or 2, with a horizontal arrow adjacent to it. The voltage across the drain/source path reaches a maximum value of 216 volts. The transistor 1602 is switched on and off only while the voltage drop across the drain/source path is zero. The duty ratio of the control voltage for the gate of the transistor 1602 is 0.5. The switching frequency of the transistor 1602 is 59 kilohertz.

FIG. 9 shows the steady-state operation once the starting phase of the high-pressure discharge lamp LP6 has been completed. The curve C shows the time profile of the essentially square-wave control voltage which is supplied from the control circuit 1613 to the gate of the transistor 1602. The drain/source path through the transistor 1602 is electrically conductive while the control voltage for the gate of the transistor 1602 is greater than zero volts. The duty ratio of the control voltage is 0.5. The switching frequency of the transistor 1602 is 215 kilohertz. The curve F shows the corresponding time voltage profile across the drain/source path through the transistor 1602. The zero levels on the two voltage profiles are indicated by the numbers 1 and 2, followed by a horizontal arrow. The curve D shows the time profile of the lamp current, and the curve E shows the time profile of the voltage across the discharge path through the high-pressure discharge lamp LP6. The zero levels on the curves D and E are indicated by the number 3 followed by a horizontal arrow. The lamp current D and the lamp voltage E are sinusoidal to a very good approximation. The root mean square value of the lamp current is 932 mA, and the root mean square value of the lamp voltage, that is to say the burning voltage of the lamp LP6, is 32.7 volts. The lamp current D and the lamp voltage E are in phase, and their frequency is 215 kilohertz.

Further exemplary embodiments of the ballast according to the invention are illustrated in FIGS. 10 to 17. The exemplary embodiments shown in FIGS. 10 to 16 differ essentially only in the starting apparatus.

The eighth exemplary embodiment of the ballast according to the invention, which is illustrated in FIG. 10, is largely identical to the first exemplary embodiment of the invention. In particular, the arrangement and operation of the components 700, 701, 702, 703 and 704 in the eighth exemplary embodiment correspond to the arrangement and the operation of the components 100, 101, 102, 103 and 104 in the first exemplary embodiment. The diode 703 is in the form of a zener diode, whose breakdown voltage is chosen to be less than the maximum permissible voltage on the switch 702, and greater than the voltage which occurs on the switch 702 during operation. This zener diode is used as overvoltage protection for the switch 702 during the lamp current inrush. A series resonant circuit comprising the capacitance 705 and the inductance 706 is connected in parallel with the capacitor 704. The electrical connections of the high-pressure discharge lamp LP7 are also connected to the series resonant circuit. The starting apparatus is in this case in the form of a DC voltage starting apparatus 707. The DC voltage output of the starting apparatus 707 is either connected directly in parallel with the resonant capacitance 705, or is connected in parallel with a series circuit formed by one or both components 701 and 706 and the resonant capacitance 705, as is indicated by dashed lines in FIG. 10. During the starting phase of the high-pressure discharge lamp LP7, a DC voltage is superimposed on the capacitance 705 or on the abovementioned series circuit and leads to ignition of the gas discharge in the high-pressure discharge lamp LP7. The starting apparatus is deactivated once the gas discharge has been ignited.

The ninth exemplary embodiment of the ballast according to the invention, which is illustrated in FIG. 11, is identical to the eighth exemplary embodiment of the invention. In particular, the arrangement and operation of the components 800, 801, 802, 803, 804, 805 and 806 in the ninth exemplary embodiment correspond to the arrangement and the operation of the corresponding components 700, 701, 702, 703, 704, 705 and 706 in the eighth exemplary embodiment. The ninth exemplary embodiment shows details of the DC voltage starting apparatus. The DC voltage starting apparatus comprises a controllable switch 809, a transformer 808 with a primary winding 808*a* and a secondary winding 808*b* wound in the opposite sense, as well as a diode 807. This starting apparatus is fed from the DC voltage source 800. The primary winding 808*a* and the switching path of the switch 809 are connected in a circuit which is connected to the DC voltage connections of the DC voltage source 800. The secondary winding 808*b* and the diode 807, which are arranged in series, are connected in parallel to the resonant capacitance 805 of the series resonant circuit in the Class E converter. This starting apparatus operates essentially on the principle of a flyback converter. During the starting phase of the high-pressure discharge lamp LP8, the switch 809 is clocked at a high frequency. During the phase in which the switch 809 is switched on, a current which leads to a magnetic field being set up in the transformer 808 flows through the primary winding 808*a*. However, no energy is transferred from the transformer 808 to the resonant capacitance 805, owing to the polarity of the diode 807 and the winding sense of the secondary winding 808*b*. In the phase when the switch 809 is switched off, the energy which is stored in the magnetic field in the transformer 808 is emitted to the resonant capacitance 805. The voltage which is induced in the secondary winding 808*b* charges the resonant capacitance 805, via the diode 807, to the starting voltage which is required in order to ignite the gas discharge in the lamp. At the end of the starting phase, the starting apparatus is deactivated by switching off the switch 809. The secondary winding 808*b* is designed such that it has a very high inductance so that no significant current flows through it because of its high reactance in operation after the gas discharge has been ignited in the lamp. If this design rule cannot be satisfied for the secondary winding 808*b*, an unbalanced lamp current caused by the diode 807 can be prevented by means of the zener diode 810 illustrated in FIG. 22, whose zener voltage is higher than the voltage across the capacitor 805 during lamp operation (after the starting phase has ended). No significant current then flows via the secondary winding 808*b* during steady-state lamp operation (after the starting phase has ended). All the other details of the circuits according to FIGS. 11 and 22 match one another.

The tenth exemplary embodiment of the ballast according to the invention, which is illustrated in FIG. 12, is identical to the eighth exemplary embodiment of the invention. In particular, the arrangement and operation of the components 900, 901, 902, 903, 904, 905 and 906 of the tenth exemplary embodiment correspond to the arrangement and the operation of the corresponding components 700, 701, 702, 703, 704, 705 and 706 of the eighth exemplary embodiment. The tenth exemplary embodiment shows details of the DC voltage starting apparatus. The DC voltage starting apparatus comprises a controllable switch 909, a transformer 908 with the primary winding 908*a* and a secondary winding 908*b* wound in the same sense, as well as a diode 907. This starting apparatus is fed from the DC voltage source 900. The primary winding 908*a* and the switching path of the switch 909 are connected in a circuit which is connected to the DC voltage connections of the DC voltage source 900. The secondary winding 908*b* and the diode 907, which are arranged in series, are connected in parallel with the series circuit formed by the resonant capacitance 905 and the resonant inductance 906 in the series resonant circuit for the Class E converter. This starting apparatus operates essentially on the principle of a forward converter during the starting phase of the high-pressure discharge lamp LP9. When the switch 909, which is clocked at a high frequency is in the switched-on phase, a current which causes an induction voltage in the secondary winding 908*b*, which is wound in the same sense, flows through the primary winding 908*a* of the transformer 908. The voltage which is induced in the secondary winding 908*b* drives a charging current into the resonant capacitance 905 via the diode 907 and the resonant inductance 906. The resonant inductance 906 is used during the starting phase of the high-pressure discharge lamp LP9 to limit the charging current to the resonant capacitance 905. The resonant capacitance 905 is charged to the required starting voltage during the starting phase of the high-pressure discharge lamp LP9. The secondary winding 908*b* is designed such that it has a very high inductance so that no significant current flows through it because of its high reactance in operation after the gas discharge has been ignited in the lamp. If this design rule cannot be satisfied for the secondary winding 908*b*, an unbalanced lamp current caused by the diode 907 can be prevented by means of the zener diode 910 illustrated in FIG. 23, whose zener voltage is higher than the voltage across the capacitor 905 and the resonant inductance 906 during lamp operation (after the starting phase has ended). No significant current then flows via the secondary winding 908*b* during steady-state lamp operation (after the starring phase has ended). All the other details of the circuits according to FIGS. 12 and 23 match one another.

FIGS. 13 to 16 show exemplary embodiments of the ballast according to the invention with a resonant starting apparatus.

The eleventh exemplary embodiment of the ballast according to the invention, which is illustrated in FIG. 13, is largely identical to the first exemplary embodiment of the invention. In particular, the arrangement and operation of the components 1000, 1001, 1002, 1003 and 1004 in the eleventh exemplary embodiment correspond to the arrangement and the operation of the components 100, 101, 102, 103 and 104 in the first exemplary embodiment. A series resonant circuit which comprises the capacitances 1005, 1007 and the inductance 1006 is connected in parallel with the capacitor 1004. The electrical connections of the high-pressure discharge lamp LP10 are also connected to the series resonant circuit. The starting apparatus is in this case in the form of a resonant starting apparatus. The capacitance 1007 is connected in parallel with the discharge path through the high-pressure discharge lamp LP10. During the starting phase of the high-pressure discharge lamp LP10, the switch 1002 is clocked at a frequency close to the resonant frequency of the series resonant circuit 1005, 1006, 1007 in the Class E converter, so that the required starting voltage for the high-pressure discharge lamp LP10 is produced by the resonant peak across the capacitor 1007. Once the gas discharge has been ignited in the high-pressure discharge lamp LP10, the switch 1002 is clocked at a frequency above the resonant frequency of the series resonant circuit, which comprises the components 1005 and 1006, since, once the gas discharge has been ignited, the capacitance 1007 is short-circuited by the discharge path through the high-pressure discharge lamp LP10.

The twelfth exemplary embodiment of the ballast according to the invention, which is illustrated in FIG. 14, is virtually identical to the eleventh exemplary embodiment. In particular, the arrangement and operation of the components 1100, 1101, 1102, 1103, 1104, 1105 and 1106 in the twelfth exemplary embodiment correspond to the arrangement and the operation of the corresponding components 1000, 1001, 1002, 1003, 1004, 1005 and 1006 in the eleventh exemplary embodiment. In contrast to the eleventh exemplary embodiment, the series resonant circuit in the Class E converter has an additional inductance 1107 which is connected in parallel with the discharge path through the high-pressure discharge lamp LP11, instead of the additional capacitance 1007. During the starting phase of the high-pressure discharge lamp LP11, the switch 1102 is clocked at a frequency close to the resonant frequency of the series resonant circuit 1105, 1106, 1107 in the Class E converter, so that the required starting voltage for the high-pressure discharge lamp LP11 is produced by a resonant peak across the inductance 1107. Once the gas discharge has been ignited in the high-pressure discharge lamp LP11, the switch 1102 is clocked at a frequency above the resonant frequency of the series resonant circuit comprising the components 1105 and 1106.

The thirteenth exemplary embodiment of the ballast according to the invention, which is illustrated in FIG. 15, is virtually identical to the eleventh exemplary embodiment. In particular, the arrangement and operation of the components 1200, 1201, 1202, 1203, 1204, 1205, 1206 and 1207 in the thirteenth exemplary embodiment correspond to the arrangement and operation of the corresponding components 1000, 1001, 1002, 1003, 1004, 1005, 1006 and 1007 in the eleventh exemplary embodiment. The diode 1203 may be a zener diode, in order to ensure overvoltage protection for the switch 1202. In contrast to the eleventh exemplary embodiment, the resonant circuit components 1206 and 1207 are stimulated by an external AC voltage source 1208 rather than by the DC voltage source in the Class E converter during the starting phase of the high-pressure discharge lamp LP12.

The fourteenth exemplary embodiment of the ballast according to the invention, which is illustrated in FIG. 16, is virtually identical to the twelfth exemplary embodiment. In particular, the arrangement and operation of the components 1300, 1301, 1302, 1303, 1304, 1305, 1306 and 1307 in the fourteenth exemplary embodiment correspond to the arrangement and operation of the corresponding components 1100, 1101, 1102, 1103, 1104, 1105, 1106 and 1107 in the twelfth exemplary embodiment. In contrast to the twelfth exemplary embodiment, the resonant circuit components 1306 and 1307 are stimulated by an external AC voltage source 1308 rather than by the DC voltage source in the Class E converter during the starting phase of the high-pressure discharge lamp LP13.

FIG. 17 shows, schematically, the outline sketch of the ballast according to the fifteenth exemplary embodiment of the invention. This ballast has a DC voltage input with two DC voltage connections, which are connected to the voltage output of a DC voltage source 1400. The positive DC voltage connection is connected to the negative DC voltage connection and to the circuit-internal ground potential via the primary winding 1401*b* of a transformer 1401 and the switching path of a controllable switch 1402. A diode 1403 is connected back-to-back in parallel with the switching path of the switch 1402. A capacitor 1404 is connected in parallel with the switching path of the switch 1402, and in parallel with the diode 1403, as well. The capacitor 1405 and the inductance 1406 are arranged in a circuit in parallel with the capacitor 1404. The capacitor 1405 and the inductance 1406 form a series resonant circuit. Electrical connections for a high-pressure discharge lamp LP14 are arranged in the series resonant circuit, so that, when the lamp LP14 is connected, its discharge path is connected in series with the series resonant circuit. The secondary winding 1401*a* generates an auxiliary voltage which, for example, can be used for the voltage supply for the control circuit for the switch 1402, or for the voltage supply for one of the starting apparatuses described above.

FIG. 18 shows one preferred exemplary embodiment of a high-pressure discharge lamp which is operated with the ballast according to the invention. This lamp is a mercury-free high-pressure discharge lamp with a power consumption of 25 watts to 35 watts, which is intended for use in a motor vehicle headlight. The discharge vessel 1 in this lamp has a tubular, cylindrical, central section 10, which is composed of sapphire. The open ends of the section 10 are closed by ceramic closure pieces 11 and 12 composed of polycrystalline aluminum oxide. The internal diameter of the circular-cylindrical section 10 is 1.5 millimeters. Two electrodes 2, 3 are arranged on the longitudinal axis of the discharge vessel 1, such that their ends on the discharge side project into the interior of the central, cylindrical section 10 and are separated from one another by 4.2 millimeters. The ionizable filling which is closed in the discharge vessel 1 is composed of xenon at a cold filling pressure of 5000 hectopascals and a total of 4 milligrams of the iodides of sodium, dysprosium, holmium, thulium and thallium. The electrodes 2 and 3 are connected to respective electrical connections 16 and 17 of the lamp cap 15 via respective power supplies 4 and 5. The discharge vessel 1 is surrounded by a translucent outer bulb 14.

The acoustic resonant frequencies of the high-pressure discharge lamp can be calculated from the distance between the electrodes, the internal diameter of the cylindrical section 10 and the speed of sound in the discharge medium, which is about 560 m/s. The fundamental frequency of the longitudinal acoustic resonance is 70 kilohertz. The fundamental frequency of the azimutal acoustic resonance is 230 kilohertz, and the fundamental frequency of the radial acoustic resonance is 476 kilohertz. This means that the fundamental frequency of the abovementioned acoustic resonances in the discharge area would in each case be stimulated by an alternating current at half the frequency of the resonances mentioned above. The acoustic resonances are well apart from one another because of the high aspect ratio of 2.8 and the small internal diameter. There is a frequency range without any resonances between each of the abovementioned acoustic resonances, in which stable lamp operation is possible without frequency modulation of the lamp alternating current. The MOSFET switch switching frequencies which have been disclosed for the sixth and seventh exemplary embodiments of the ballast according to the invention, and alternating current frequencies of 360 kilohertz and 215 kilohertz are thus in a frequency range in which there are no resonances.

FIG. 19 shows the high-pressure discharge lamp illustrated in FIG. 18 with a circuit arrangement 18 arranged in the lamp cap 15. This circuit arrangement 18 comprises either the complete ballast for the high-pressure discharge lamp including the starting apparatus, or else only the starting apparatus for the high-pressure discharge lamp.

FIG. 20 shows the design of a Class E converter according to the prior art. The design and the operation of this Class E converter are described on pages 271 to 273 of the book "Power electronics: converters, applications, and design" by the authors Ned Mohan, Tore M., Undeland and William P. Robbins, second edition 1995, John Wiley & Sons, Inc.

This Class E converter has a DC voltage input with two DC voltage connections, which are connected to the voltage output of a DC voltage source 1500. The positive DC voltage connection is connected to the negative DC voltage connection and to the circuit-internal ground potential via an inductance 1501 and the switching path of a controllable switch 1502. A diode 1503 is connected back-to-back in parallel with the switching path of the switch 1502. A capacitor 1504 is connected in parallel with the switching path of the switch 1502, and in parallel with the diode 1503, as well. The capacitor 1505 and the inductance 1506 are arranged in a circuit in parallel with the capacitor 1504. The capacitor 1505 and the inductance 1506 must be selected such that the parallel circuit is a series resonant circuit. The load RL is connected in series with the series resonant circuit.

There is no need for the P6KE440 protective diodes mentioned in Tables 1 and 2.

FIG. 21 shows, schematically, the outline sketch of the ballast according to the sixth exemplary embodiment of the invention. This ballast has a DC voltage input with two DC voltage connections +,−, which are connected to the voltage output of a DC voltage source. The DC voltage source produces an input voltage of 42 volts for the Class E converter across the capacitor C4, which is connected in parallel with the voltage input of the Class E converter. The positive DC voltage is connected via a first winding section of the autotransformer L2 and the switching path through the controllable field-effect transistor T to the negative DC voltage connection and to the ground potential within the circuit. The body diode of the MOSFET transistor T, which is connected back-to-back in parallel with the switching path through this transistor T, carries out the function of the diode 1503 in the Class E converter illustrated in FIG. 20. A capacitor C2 is connected in parallel with the switching path through the transistor T, and in parallel with its body diode. The capacitor C5 and the primary winding n1 of a transformer Tr1 are arranged in a circuit in parallel with the capacitor C2. The transformer Tr1 is used for impedance matching between the lamp La and the Class E converter. The secondary winding n2 of the transformer Tr1 is connected in series with the capacitor C1, the secondary winding of the starting transformer L1, the discharge gap in the high-pressure discharge lamp La and the resistor R3. A suppressor diode D5, for example a transil diode, is connected in parallel with the series circuit formed by the secondary winding of the starting transformer L1 and the discharge gap in the lamp La, and is used for voltage limiting.

The pulsed starting apparatus, which comprises the diode D2, the resistor R2, the spark gap FS, the starting capacitor C3 and the starting transformer L1, is connected to the second winding section L2*b* of the autotransformer L2. The starting capacitor C3 is connected in parallel with the series circuit formed by the spark gap FS and the primary winding L1*b* of the starting transformer L1. The voltage drop across the starting capacitor C3 is monitored by the control circuit for the transistor T by means of the voltage divider resistors R4, R5. Furthermore, the control circuit for the transistor T also monitors the lamp current, by means of the resistor R3. The control circuit for the transistor T comprises a logic part and driver circuits for the transistor T. Table 3 shows the design of the components for the sixteenth exemplary embodiment. The lamp La is a mercury-free halogen metal-vapor high-pressure discharge lamp with a discharge vessel composed of quartz glass, which has an electrical power consumption of about 35 watts, and an operating voltage of about 45 volts. This mercury-free halogen metal-vapor high-pressure discharge lamp is operated by means of the Class E converter with an AC voltage whose frequency is above the acoustic resonances of the lamp.

The Class E converter is supplied from the DC voltage source with an input voltage of 42 volts. During the starting phase of the high-pressure discharge lamp La, the transistor T is operated at a switching frequency of 230 kilohertz by means of the control circuit. This means that the control circuit for the transistor T slowly reduces the switching frequency of the transistor T, starting from a value slightly above 230 kilohertz, until the required breakdown voltage for the spark gap FS has been built up across the starting capacitor C3, and this is detected by the control circuit for the transistor T, by means of the voltage divider R4, R5. When the spark gap FS breaks down, the starting capacitor C3 is discharged via the primary winding L1*b* of the starting transformer L1. High-voltage pulses are generated in the secondary winding of the starting transformer L1, in order to ignite the gas discharge in the high-pressure discharge lamp La. Once the gas discharge in the lamp La has been ignited, a current flows via the discharge gap in the high-pressure discharge lamp La. This lamp current is detected by the control circuit for the transistor T by means of the resistor R3, and the switching frequency of the transistor T is then suddenly increased to a value of 925 kilohertz. This results in the so-called start-up for the lamp La, during which the lamp La is operated at about three times its rated power, in order to vaporize the metal halides quickly. During the start-up, the switching frequency of the transistor T is increased to the steady-state final value of 955 kilohertz, in order to operate the lamp La at a power level close to its rated power of 35 watts.

During lamp operation, the control apparatus for the transistor T monitors the voltage drop across the resistor R3, which is proportional to the lamp current. If this falls below a predetermined level, then this is interpreted by the control circuit as the lamp La having gone out, and the switching frequency of the transistor T is once again automatically set to a value of about 230 kilohertz, in order to initiate the starting phase for the lamp La once again.

Alternatively, the fact that the lamp La has gone out can also be identified by means of the voltage divider resistors R4, R5 by a voltage rise across the starting capacitor C3. Alternatively, the successful starting of the lamp La can likewise be detected by means of the voltage divider resistors R4, R5 by the fact that the voltage drop across the starting capacitor C3 remains considerably below the breakdown voltage of the spark gap FS over a relatively long time period of, for example, 100 ms or 10 cycle periods.

The invention is not restricted to the exemplary embodiments explained in relatively great detail above. For example, in order to improve the matching of the lamp to the Class E converter, the capacitor 1504 or the corresponding capacitors 104, 204, 304, 404, 504, 604, 1604, 704, 804, 904, 1004, 1104, 1204, 1304, 1404 and C2 in the exemplary embodiments described above may be in the form of capacitors with a variable capacitance. The capacitance may in this case either be varied continuously between a minimum value and a maximum value, or else may be switched between a number of discrete values, for example two discrete values. It is thus possible to ensure a high efficiency despite a change in the lamp resistance, caused, for example, by the starting of the gas discharge in the lamp or the vaporization of the metal halides in the discharge vessel of the lamp, with only a small variation in the switching frequency being required. Particularly in the case of the exemplary embodiments with resonant starting as shown in FIGS. 13 and 14, matching of the resonant circuit by adjustment of the capacitance of the capacitor 1004 or 1104 to a first value during starting and switching to a second value after the lamp has been started is advantageous. This can be achieved, for example, by the capacitor 1004 or 1104 being in the form of two capacitors connected in parallel, one of which is activated or deactivated with the aid of a switching means.

The starting apparatus 107 may, as already explained, contain a pulse source which produces one voltage pulse or a sequence of voltage pulses in order to ignite the gas discharge in the high-pressure discharge lamp. Instead of the pulse source, this may also contain any desired AC voltage source which produces a relatively long-lasting AC voltage. The frequency of this AC voltage is set to be sufficiently high that the capacitors 104, 105; 204, 205; 304, 305 and 404, 405 have a very low reactance at this frequency, and can be regarded as a short. A suppressor diode may be connected in parallel with one of the two abovementioned capacitors, or in parallel with both capacitors, for voltage limiting, particularly when it is not possible to guarantee that the reactance will be very low.

As an alternative to the starting apparatuses explained above, a piezo transformer can also be used to produce the starting voltage for the high-pressure discharge lamp. FIG. 24 shows an exemplary embodiment of the Class E converter with DC voltage starting analogous to the exemplary embodiment shown in FIG. 10. The Class E converter is in this case formed by the components L200, S100, D100, C200, L100 and C100, whose function is the same as that of the corresponding components 701, 702, 703, 704, 705 and 706 shown in FIG. 10. According to the exemplary embodiment shown in FIG. 24, a piezo transformer PT is connected in parallel with the switch S100 and produces the high voltage for charging the capacitor C100 by means of the voltage doubler, comprising the diodes D700 and D800. The zener diode D900 prevents a short on one side of the resonant circuit, which is formed from L100 and C100, during operation, and has the same function as the zener diode 910 in FIG. 23. A single half switch S100 is thus still sufficient to start and to operate the high-pressure discharge lamp La. For example, this makes it possible to save the switch 909 which is required to produce the starting voltage according to FIG. 23. Owing to the input capacitance of the piezo transformer PT, it can partially or completely carry out the function of the capacitor C200. The high voltage generation is switched off by varying the switching frequency of S100. A minor change in the switching frequency is sufficient, because piezo transformers have very narrowband resonances, owing to their high Q factor.

The ballast according to the invention is preferably used for operation of a high-pressure discharge lamp for motor vehicle headlights, in particular a halogen metal-vapor high-pressure discharge lamp with a translucent ceramic discharge vessel, as is shown in FIGS. 18 and 19, and is described, by way of example, in German Patent Application DE 102 42 740, or a halogen metal-vapor high-pressure discharge lamp with a translucent discharge vessel composed of quartz glass, as is disclosed, by way of example, in Patent Application DE 103 12 290.

TABLE 1

Details of the components according to the sixth exemplary embodiment of the invention

| Component | Details |
|---|---|
| Autotransformer 601 | ETD29, N67 |
| Primary winding 601a | 49 turns, 300 μH |
| Secondary winding 601b | 131 turns |
| Field-effect transistor 602 with the integrated diode 603 | IRF830, International Rectifier |
| Capacitance 604 | 4.7 nF, 600 V |
| Capacitance 605 | 1.5 nF, 1500 V |
| Transformer 606 | 150 μH, |
| Primary winding 606a | 1 turn |
| Secondary winding 606b | 40 turns |
| Starting capacitor 607 | 70 nF, 1000 V |
| Spark gap 608 | 800 V, EPCOS FS08X-1JM |
| Resistor 609 | 110 kOhm, 0.5 W |
| Diode 610 | 1 500 V, two US1M in series, two P6KE440 in series in parallel with each US1M |
| Capacitance 611 | 11 μF, electrolytic capacitor 10 μF/100 V in parallel with 1 μF/630 V film capacitor |
| High-pressure discharge lamp LP6 | 30 Volt, 30 watts (rating date) |

TABLE 2

Details of the components according to the seventh exemplary embodiment of the invention

| Component | Details |
|---|---|
| Autotransformer 1601 | ETD39, N67 |
| Primary winding 1601a | 39 turns, 300 μH |
| Secondary winding 1601b | 190 turns |
| Field-effect transistor 1602 with the integrated diode 1603 | IRF740, International Rectifier |

TABLE 2-continued

Details of the components according to the seventh exemplary embodiment of the invention

| Component | Details |
|---|---|
| Capacitance 1604 | 14.1 nF |
| Capacitance 1605 | 17.4 nF |
| Capacitance 1661 | 10 μF, 100 V film capacitor |
| Starting Transformer 1606 | 150 μH |
| Primary winding 1606a | 1 turn |
| Secondary winding 1606b | 40 turns |
| Starting capacitor 1607 | 70 nF, 1000 V |
| Spark gap 1608 | 800 V, EPCOS FS08X-1JM |
| Resistor 1609 | 110 kOhm, 0.5 W |
| Diode 1610 | 1500 V, two US1M in series, two P6KE440 in series in parallel with each US1M |
| Transformer 1614 | ETD29, N67 |
| Primary winding 1614a | 26 turns |
| Secondary winding 1614b | 52 turns |
| High-pressure discharge lamp LP16 | 30 Volt, 30 watts (rating date) |

TABLE 3

Details of the components according to the sixteenth exemplary embodiment of the invention

| Component | Details |
|---|---|
| C1 | 200 pF |
| C2 | 1.0 nF |
| C3 | 70 nF |
| C4 | 10 μF |
| C5 | 680 nF |
| D2 | 2000 V, two US1M in series |
| D5 | 2000 V, bidirectional voltage limiting by four P6KE520C in series |
| FS | 800 V, EPCOS FS08X - 1JM |
| L1 | Secondary winding, 40 turns, 150 μH |
| L1b | 1 turn |
| L2 | 10 turns, EFD20, N59, 18 μH |
| L2b | 33 turns |
| R2 | 10 kilohms |
| R3 | 0.5 ohms |
| R4 | 10 megaohms |
| R5 | 47 kilohms |
| T | IRFP460LC, 400 V, 10 A, 0.55 ohms (International Rectifier) |
| TR1 | n1 = 8 turns, n2 = 45 turns, EFD25, N59 |

The invention claimed is:

1. A ballast for operation of at least one high-pressure discharge lamp, with the ballast having a voltage converter for production of an essentially sinusoidal alternating current, the voltage converter being in the form of a Class E converter which has DC voltage inputs, wherein an inductance and the switch path of a controllable switching means are connected between the DC voltage inputs, and a diode is arranged back-to-back in parallel with the switch path of the controllable switching means, and a capacitance is arranged in parallel with the switch path of said controllable switching means and in parallel with said diode, with the inductance being of such magnitude that it acts as a constant-current source, and a parallel circuit, which is in the form of a series resonant circuit, is provided for said capacitance, to which parallel circuit the at least one high-pressure discharge lamp to be operated is coupled, the current which flows in the closed state via the switch path of said controllable switching means and in the open state via said capacitance being composed of a direct current and a sinusoidal alternating current, which is generated by the series resonant circuit.

2. The ballast as claimed in claim 1, wherein a positive DC voltage input is connected via the inductance and the switching path of said controllable switching means to a negative DC voltage input and to ground potential, and electrical connections are a provided for said at least one high-pressure discharge lamp, and are coupled to the series resonant circuit.

3. The ballast as claimed in claim 1, wherein the ballast has a starting apparatus for starting a gas discharge in the high-pressure discharge lamp.

4. The ballast as claimed in claim 3, wherein the starting apparatus is coupled to an inductance in the Class E converter for its voltage supply.

5. The ballast as claimed in claim 3, wherein the starting apparatus is in the form of a pulse starting apparatus.

6. The ballast as claimed in claim 3, wherein the starting apparatus is in the form of a DC voltage starting apparatus.

7. The ballast as claimed in claim 3, wherein the starting apparatus is in the form of a resonant starting apparatus.

8. The ballast as claimed in claim 3, wherein the starting apparatus contains a piezo transformer.

9. The ballast as claimed in claim 8, wherein the input or the primary of the piezo transformer is connected in parallel with a switch of the Class E converter.

10. The ballast as claimed in claim 4, wherein the inductance is in the form of an autotransformer.

11. The ballast as claimed in claim 5, wherein the secondary winding of the starting transformer of the pulse starting apparatus is in the form of a component of a series resonant circuit of the Class E converter.

12. The ballast as claimed in claim 6, wherein the DC voltage starting apparatus is coupled to a capacitance in a series resonant circuit of the Class E converter.

13. The ballast as claimed in claim 1, wherein a transformer is provided for impedance matching of the at least one high-pressure discharge lamp.

14. A lighting system having a high-pressure discharge lamp and having a ballast as claimed in claim 1, with the high-pressure discharge lamp having a discharge vessel with electrodes arranged in it and with a filling, which can be ionized in order to produce a gas discharge.

15. The lighting system as claimed in claim 14, wherein the inductance and the capacitance in a series resonant circuit of the Class E converter are matched to the distance between the electrodes and to the geometry of the discharge vessel such that the resonant frequency of the series resonant circuit is in a frequency range which is free of acoustic resonances of the high-pressure discharge lamp.

16. The lighting system as claimed in claim 15, wherein the discharge vessel has a cylindrical geometry, at least in the area of the gas discharge.

17. The lighting system as claimed in claim 14, wherein the ballast has a starting apparatus for starting the gas discharge in the high-pressure discharge lamp.

18. The lighting system as claimed in claim 17, wherein the starting apparatus is in the form of a pulse starting apparatus, with the secondary winding of the starting transformer of the starting apparatus being arranged in the Class E converter.

19. The lighting system as claimed in claim 17, wherein the starting apparatus is arranged in the cap of the high-pressure discharge lamp.

20. The lighting system as claimed in claim 14, wherein the ballast is arranged in the cap of the high-pressure discharge lamp.

21. The lighting system as claimed in claim 14, wherein the high-pressure discharge lamp has a rating in the range from 25 watts to 35 watts.

22. The lighting system as claimed in claim 14, wherein the burning voltage of the high-pressure discharge lamp is not more than 100 volts.

23. The lighting system as claimed in claim 14, wherein the lighting system is a motor vehicle headlight.

* * * * *